United States Patent [19]

Rol

[11] 4,422,285

[45] Dec. 27, 1983

[54] APPARATUS AND PROCESS FOR MAKING A FUR YARN

[76] Inventor: Gabriel Rol, 64 de Bretagne, St-Lambert Quebec, Canada

[21] Appl. No.: 316,031

[22] Filed: Oct. 28, 1981

[51] Int. Cl.[3] ..... A41H 41/00; C14B 15/10; D02G 3/06

[52] U.S. Cl. ..... 57/31; 57/7; 57/200; 57/259; 57/260

[58] Field of Search ..... 57/200, 203, 210, 224, 57/232, 233, 235, 248, 250, 258–260, 4, 6, 7, 24, 28, 31, 59, 62, 282, 292, 295, 296, 903, 32

[56] References Cited

U.S. PATENT DOCUMENTS

| | | | |
|---|---|---|---|
| 507,232 | 10/1893 | Maertens | 57/295 |
| 1,119,120 | 12/1914 | Salzberger | 57/203 |
| 3,243,948 | 4/1966 | Flanigan | 57/62 X |
| 3,791,132 | 2/1974 | Schultz et al. | 57/59 X |

FOREIGN PATENT DOCUMENTS

| | | | |
|---|---|---|---|
| 4458 | 10/1979 | European Pat. Off. | 57/210 |

*Primary Examiner*—Donald E. Watkins

*Attorney, Agent, or Firm*—Cushman, Dauby, Cushman

[57] ABSTRACT

A novel fur yarn is provided and comprises a core of a permanently twisted strand of animal skin and a fluffy exterior consisting of animal hair; the process of making such fur yarn consists in slicing a narrow elongated strand of such fur, twisting this strand, wetting the twisting strand and, then, letting this wet twisted strand to dry so that it may retain its twisted shape; the invention is also concerned with an apparatus for making such fur yarn.

12 Claims, 7 Drawing Figures

4
4
10
12
14
15
16
16A
16B
17
18
22
23
24
24'
26
28
30
32
34
36
38
40
50
50'
52
54
56
58
70
72
76
78

APPARATUS AND PROCESS FOR MAKING A FUR YARN

The present invention relates to the production of fur yarn; more particularly, it relates to a process for making such a fur yarn and to an apparatus used in the carrying out of this process.

Until the present time, there has never been any practical means or methods of forming a fur yarn for the production of woven and knitted fabrics such as cardigans, pullovers, jackets or the like, of warm, soft and attractive appearance. The yarn of such nature may be described as all fur and not any fur-and-fabric mixture. The animal fur may be of various kinds such as mink, lynx or any quantity combination of any number of furs, the selection or combinations selected obviously differing considerably in view of the physical characteristics of each fur.

A fur yarn made in accordance with the present invention, comprises a core that consists essentially of a permanently twisted strand of animal skin and a fluffy exterior which is the animal hair.

It can be seen that a ball of such a fur yarn may thus be formed for knitting. Such ball would be formed of strands of yarns which would be successively sewn together.

The fur yarn of the present invention is made by first cutting a fur skin into very narrow slices or strands. Each strand or series of strands is then twisted to form a thin yarn. The twisted yarn is subsequently bathed in a liquid and left to dry so that it may retain its twisted shape.

The present invention is also concerned with an apparatus for carrying out this process, the apparatus comprising a rotatable bobbin means having wound thereon a strand of animal fur consisting of a narrow elongated skin portion and hair extending from one face thereof; means for drawing the strand from the bobbin means; means for rotating the bobbin means to impart a twist to the strand as it is drawn from the bobbin means; spring-biased support means located above the rotatable bobbin means receiving the strand being twisted; the drawing means include drum means receiving thereon the twisted strand downstream of the support means and means for rotating the drum means; and means for wetting the twisted strand on the drum means to allow the strand to maintain its twisted shape and to form a fur yarn.

The function of the spring-biased support means above the bobbin means has an important role. As the strand is twisted, its length diminishes. Therefore, the support means must give to the pulling force exerted by this shortening of the yarn. On the other hand, the twisted yarn is constantly pulled by the drum means; therefore, the support means must return to its original position as a new length of untwisted yarn is delivered from the bobbin means. This return action is accomplished by the spring element associated with the support means.

One embodiment of the present invention will now be described with reference to the accompanying drawings in which.

Figures 1, 2, 3:
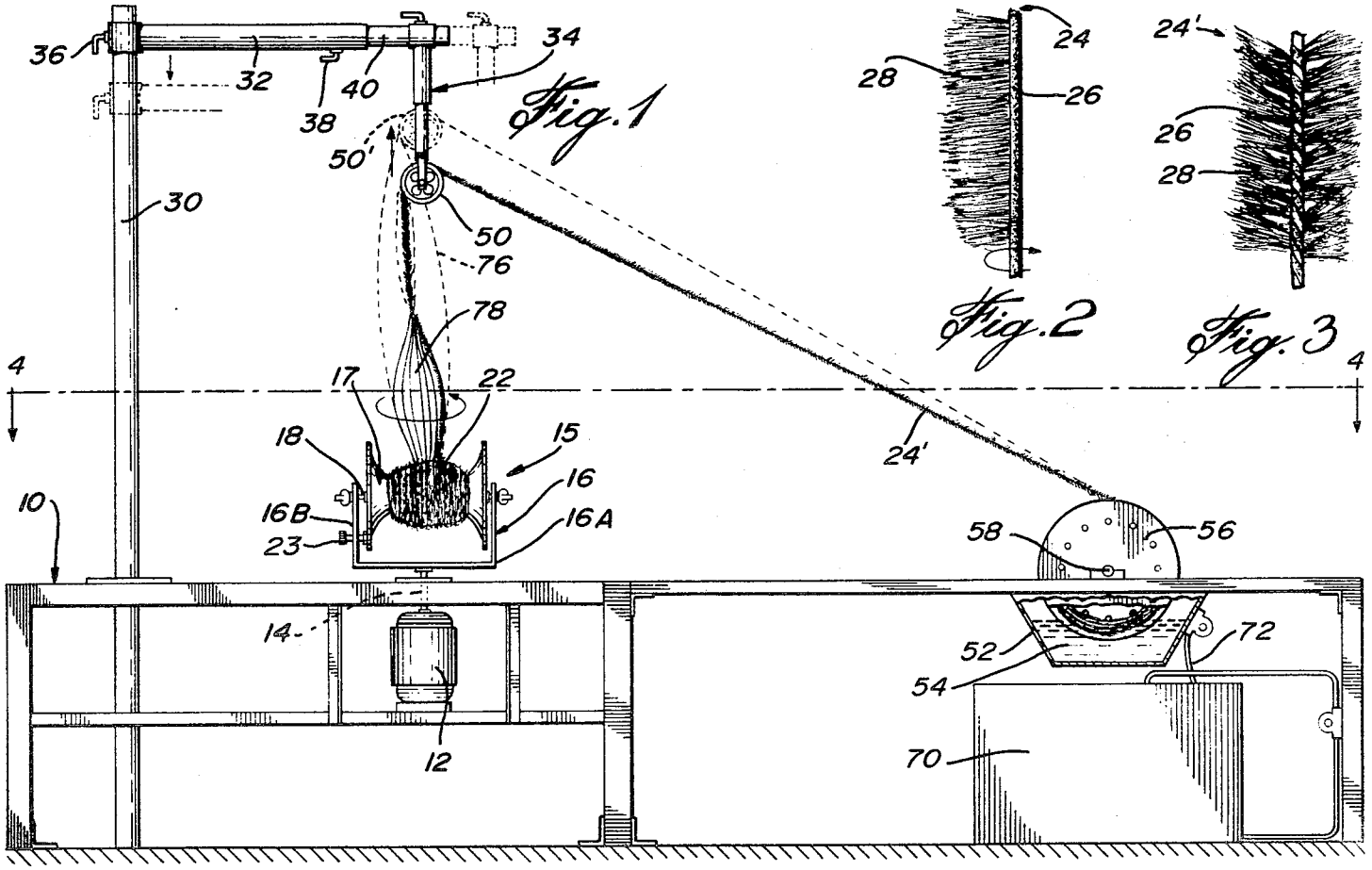
FIG. 1 is a front elevational view showing one embodiment of an apparatus for making a fur yarn in accordance with the present invention.
FIG. 2 shows a strand of fur prior to being twisted.
FIG. 3 shows a fur yarn made in accordance with the present invention.
Figure 4:
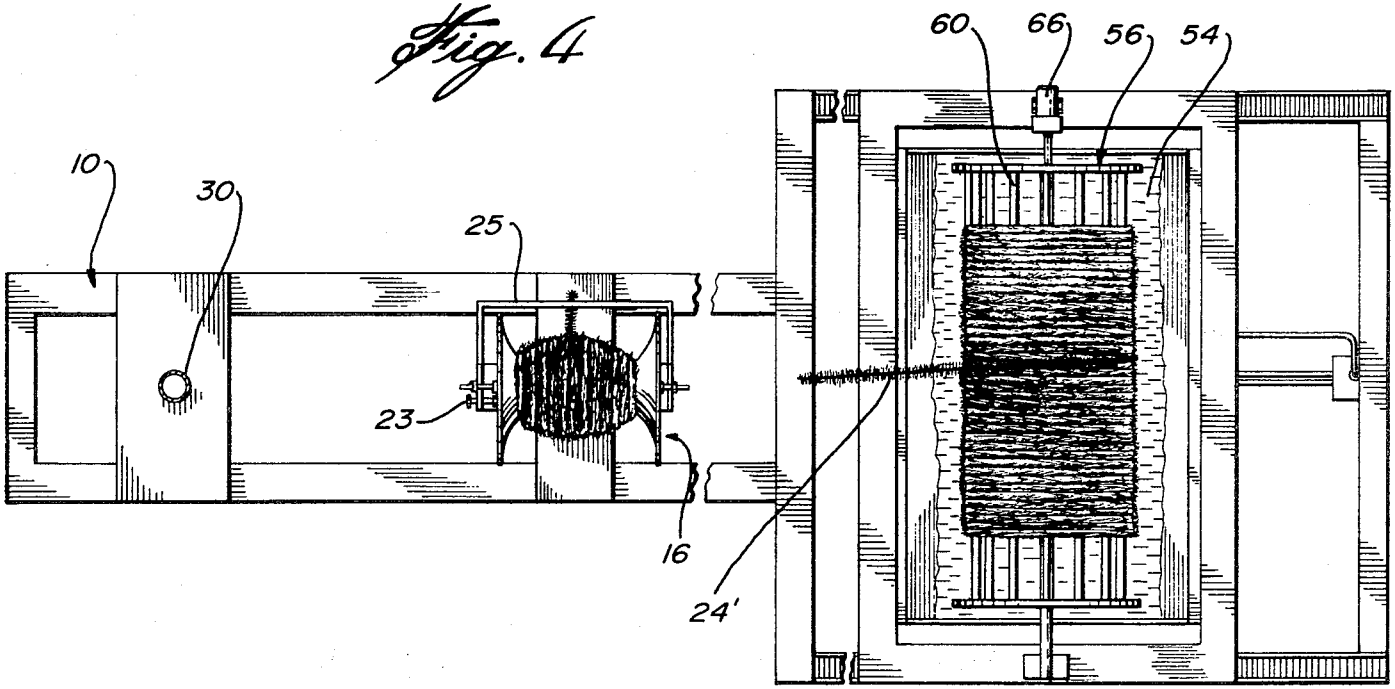
FIG. 4 is a plan view taken along lines 4—4 of FIG. 1.

Referring to FIG. 1, the apparatus shown comprises a frame structure 10 on which is fixedly mounted a motor 12 having a vertically extending drive shaft 14. The upper end of shaft 14 is fixed to the bottom portion of a rotatable bobbin-carrying device 15 that includes a yoke-like member 16, displaying a pair of upstanding side walls **16*a* and 16*b*, and a bobbin 17 which is rotatably mounted on an axis 18 having its opposite ends supported on side walls 16*a* and 16*b*. A bundle of yarn 22 is wound on bobbin 17. A manually operable brake device 23 is mounted to wall 16*b* and frictionally engages one side of bobbin 17 to control the yarn unwinding rotation of the bobbin, as further described below. Referring to FIG. 4, the unwound portion 24 of the yarn passes under a horizontally extending U-shaped member 25 having its opposite extremities fixedly supported on axis 18; this member 25** ensures a certain distance between the bundle and the area where yarn twisting will be carried out thereby preventing yarn entanglement on the bundle.

Referring to FIG. 2, the yarn is formed from a narrow slice (e.g. one millimiter) of an animal fur that consists of skin portion 26 and hair portion 28. The bundle wound on the bobbin is usually formed of a series of such slices which are successively sewn to one another.

The frame structure 10 also supports a vertically extending stand 30 at the upper end of which extends a horizontal member 32 carrying a suspension device 34. A locking device 36 is provided on the stand 30 to adjust the height of member 32 relative to the bobbin. Similarly, member 32 includes a lock device 38 to adjust the relative distance of the mechanism 34 with respect to the bobbin by telescopically moving a tubular member 40 relative to member 32.

Figure 6:
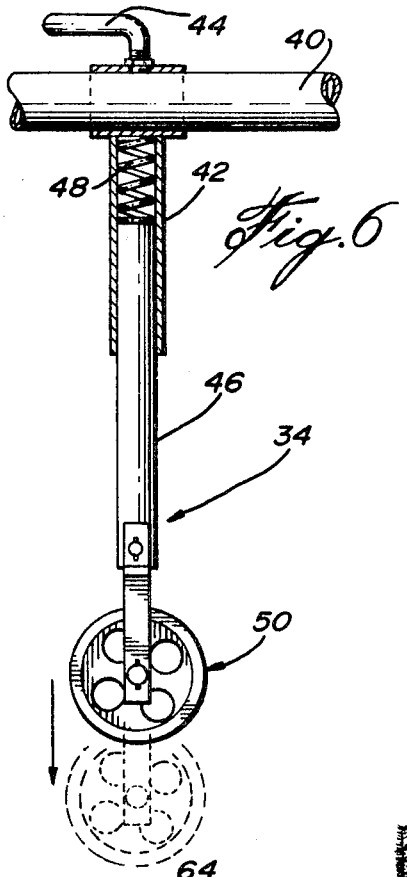
FIG. 6 is an elevational view, partly sectional, of the suspension device used in the apparatus of the present invention.
Figure 7:
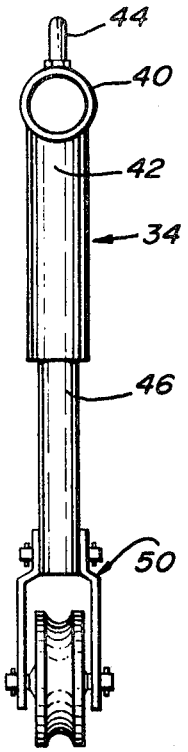
FIG. 7 is a side view of the device shown in FIG. 6.
Figure 5:
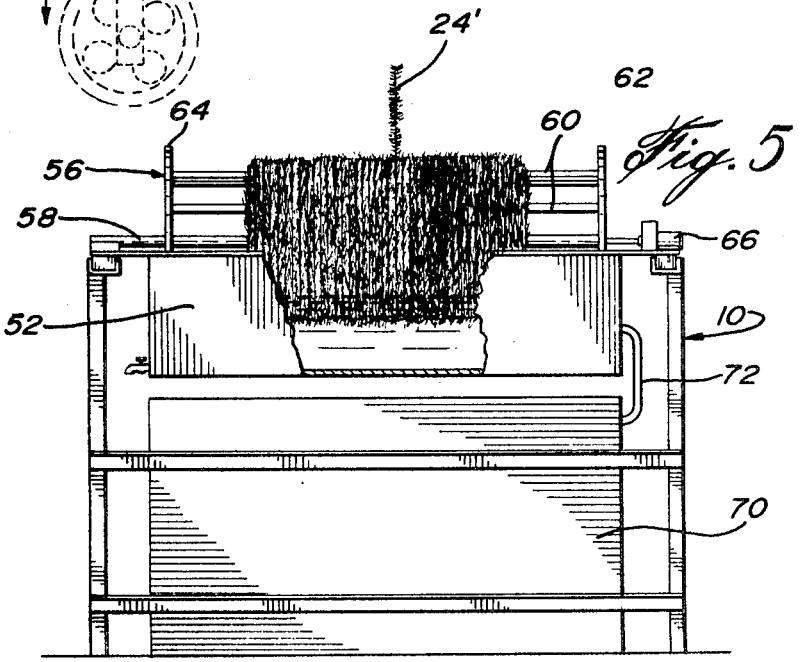
FIG. 5 is a side elevational view showing only the drum means and the wetting means of the apparatus of the present invention.

Referring to FIGS. 6 and 7, the suspension device 34 includes a cylindrical member 42 which can be fixed by means of key 44 to the tubular member 40. A second cylindrical member 46 is partially received in member 42 and is biased therein by means of a spring 48. The lower end of cylindrical member 46 supports a pulley 50 over which is passed the strand of fur as described hereinbelow.

The frame 10 also supports a basin 52 mounted at a given distance with respect to bobbin device 15. A liquid 54, such as water, partially fills the basin. A drum is mounted to rotate on a horizontal axis 58 having its opposite ends supported on frame 10. Drum 56 consists of a series of circumferentially spaced rods 60 secured to opposite disc plates 62 and 64. Rotation of the drum 56 is effected by a second motor 66 also mounted to the frame 10 and connected to axis 58 by a chain and sprocket arrangement 68. A container 70 is provided to supply liquid 54 to basin 52 through conduits 72.

In operation, the free end of the fur strand 24 of bundle 22 on bobbin 17 is passed over the pulley 50 and secured to the drum rods 60. Then, motors 66 and 12 are operated, respectively causing the rotation of drum 56 about axis 58 and the rotation of yoke-like member 16 about axis 14. The rotational speed of the device 15 is much higher than that of drum 56. There results a fast spinning action of the strand between the bundle 22 and the pulley 50 providing the visual effect of an ovoid shape such as illustrated by the dotted lines 76. However, the spinning and twisting of this strand causes a restriction in the length of strand that extends between the pulley and the bundle. The shortening in the length of the strand causes a pulling force on the pulley 50, which force is allowed to avoid breaking of the strand by spring 48. The gradual shortening of the strand being twisted can be seen by the reduced ovoid shape 78. The continuous pulling force by the drum 56 reduces the twisted portion of the strand between the pulley and the bobbin, thereby diminishing the pull exerted by the strand whereby spring 48 causes pulley 50 to return to its original position indicated in dotted lines 50' in FIG. 1.

These changes in the ovoid shapes of the strand being twisted continue throughout the entire winding operation of the fur yarn formed and having the structure shown in FIG. 3.

Depending on the type of animal fur used, and also on the amount of twist to be given to the fur yarn, the rotational speeds of the motors 12 and 66 as well as the height of the pulley 50 with respect to the bobbin will be adjusted accordingly.

Once the entire fur yarn formed will have been wound on drum 56, it will be in a wet state as a result of its many rotational passages in liquid 54 of basin 52. The drum is then removed from the frame and set aside to let the fur yarn to dry. Once dried, the fur yarn maintains the shape shown in FIG. 3, that is a twisted core 26 with a fluffy hair portion extending therearound.

Although the present invention has been described with respect to one specific form of the invention, it will be evident to the man skilled in the art that it may be refined and modified in various ways. For example, two bobbin carrying devices may be used and driven so that two twisted fur yarns be formed and together twisted to form a composite fur yarn. It is therefore wished to have it understood that the present invention should not be limited in interpretation except by the terms of the following claims.

The embodiments of the invention in which an exclusive property or privilege is claimed are defined as follows:

1. An apparatus for making a fur yarn comprising: rotatable bobbin means having wound thereon a strand of animal fur consisting of a narrow elongated skin portion and of hair extending from one face of the skin portion; means drawing said strand from said bobbin means; means for rotating said bobbin means to impart a twist to said strand as it is drawn from said bobbin means; spring-biased support means located above said rotatable bobbin means receiving said strand being twisted; said drawing means including drum means receiving thereon said twisted strand downstream of said support means and means for rotating said drum means; and means for wetting said twisted strand on said drum means to allow said strand to maintain its twisted shape and to form a fur yarn.

2. An apparatus as defined in claim 1, wherein said rotatable bobbin means include a yoke member rotatable about a vertical axis and a bobbin element supported on said yoke member and rotatable about a horizontal axis.

3. An apparatus as defined in claim 1, wherein said support means include a member in freely hanging position over said bobbin means; said member having, at the lower end thereof, means for allowing passage of said twisted yarn from said bobbin means to said drum means.

4. An apparatus as defined in claim 3, wherein said means allowing passage for said twisted yarn comprises a pulley fixed to the lower end of said member.

5. An apparatus as defined in claim 3, wherein said member includes a spring allowing said lower end to move relatively to said bobbin means in response to force exerted by said strand shortening in length as a result of it being twisted and in response to the displacement of the twisted yarn as a result of it being drawn by and wound on said drum means.

6. An apparatus as defined in claim 1, wherein said wetting means comprise a liquid containing basin located beneath said drum means, and partially receiving said drum means with said twisted yarn thereon.

7. An apparatus as defined in laim 6 further comprising a reservoir for supplying liquid to said basin.

8. An apparatus as defined in claim 2, further comprising means on said yoke member for limiting the rotation of said bobbin element as said strand is drawn off therefrom.

9. An apparatus as defined in claim 3, further comprising stand means carrying said support means; means on said stand means for adjusting the relative position of said freely hanging member with respect to said bobbin means.

10. A process for making a fur yarn comprising the steps of: twisting a narrow elongated strand of animal fur to form a twisted strand; resiliently opposing the pulling force exerted by the shortening of said strand as a result of said strand being twisted; wetting said twisted strand; and letting said wet twisted strand to dry so that it may retain its twisted shape and form a fur yarn.

11. A process for making a fur yarn comprising the steps of: winding a narrow elongated strand of animal fur on a bobbin; passing one end of said strand over a spring-biased suspension element located above said bobbin; fixing said one end to a rotatable drum; rotating said bobbin to impart a twisting effect to said strand; rotating said drum to wind said twisted yarn on said drum after having passed at said suspension element; wetting said twisted yarn on said drum; and letting said twisted yarn to dry on said drum so as to allow said yarn to retain its shape and form a fur yarn.

12. An apparatus as defined in claim 2 further comprising means mounted to said bobbin element to prevent, adjacent said bobbin element, entanglement of said yarn as a result of the twisting.

* * * * *